US008978225B2

(12) United States Patent
James

(10) Patent No.: US 8,978,225 B2
(45) Date of Patent: Mar. 17, 2015

(54) FRANGIBLE POSTS

(75) Inventor: Dallas Rex James, Auckland (NZ)

(73) Assignee: Valmont Highway Technology Limited, East Tamaki, Auckland (NZ)

( * ) Notice: Subject to any disclaimer, the term of this patent is extended or adjusted under 35 U.S.C. 154(b) by 19 days.

(21) Appl. No.: 12/670,678

(22) PCT Filed: Jul. 28, 2008

(86) PCT No.: PCT/NZ2008/000189

§ 371 (c)(1),
(2), (4) Date: Apr. 7, 2010

(87) PCT Pub. No.: WO2009/017427

PCT Pub. Date: Feb. 5, 2009

(65) Prior Publication Data

US 2010/0192482 A1 Aug. 5, 2010

(30) Foreign Application Priority Data

Jul. 27, 2007 (NZ) ..... 556782

(51) Int. Cl.

| | |
|---|---|
| ***E01F 15/02*** | (2006.01) |
| ***B26D 3/14*** | (2006.01) |
| ***B26F 1/12*** | (2006.01) |
| ***E01F 9/018*** | (2006.01) |
| ***E01F 15/04*** | (2006.01) |

(52) U.S. Cl.

CPC ..... *E01F 9/0182* (2013.01); *E01F 15/0461* (2013.01)

USPC ..... 29/413; 404/10; 52/98

(58) Field of Classification Search

CPC ... E01F 15/143; E01F 9/0182; E01F 15/0461; E01F 13/026

USPC ..... 52/98; 29/413, 414, 525.14; 428/43, 428/571, 572; 404/6, 9, 10; 248/909

See application file for complete search history.

(56) References Cited

U.S. PATENT DOCUMENTS

| | | | | |
|---|---|---|---|---|
| 1,722,994 | A | | 8/1929 | Burd |
| 1,828,349 | A | | 10/1931 | Williams |
| 1,951,470 | A | * | 3/1934 | Cole ..... 29/506 |
| 2,244,042 | A | | 6/1941 | Barlow |
| 2,561,206 | A | | 7/1951 | Kaspar |
| 2,976,923 | A | | 3/1961 | Hirashiki |
| 3,204,606 | A | | 9/1965 | Parr et al. |
| 3,350,039 | A | | 10/1967 | Crater |
| 3,537,687 | A | | 11/1970 | Adelman |
| 3,617,076 | A | | 11/1971 | Attwood et al. |
| 3,738,599 | A | | 6/1973 | Borehag |

(Continued)

FOREIGN PATENT DOCUMENTS

| | | |
|---|---|---|
| AU | 199674061 | 6/1997 |
| CA | 2167548 | 1/1996 |

(Continued)

OTHER PUBLICATIONS

Supplementary European Search Report for Application No. 08793951.8-1604 / 2183434 PCT/NZ2008000 189, Oct. 9, 2013.

*Primary Examiner* — Christine T Cajilig

(74) *Attorney, Agent, or Firm* — Greer, Burns & Crain, Ltd.

(57) ABSTRACT

A method of producing a frangible post includes the step of forming a region of weakness by compressing a portion of at least one surface and/or edge of the post.

16 Claims, 3 Drawing Sheets

(56) References Cited

U.S. PATENT DOCUMENTS

| | | | | |
|---|---|---|---|---|
| 3,776,520 | A | 12/1973 | Charles et al. | |
| 3,866,397 | A | 2/1975 | Koziol | |
| 3,912,404 | A | 10/1975 | Katt | |
| 3,982,734 | A | 9/1976 | Walker | |
| 4,047,702 | A | 9/1977 | Cernia et al. | |
| 4,183,317 | A * | 1/1980 | Follick | 116/63 P |
| 4,222,552 | A | 9/1980 | Matteo, Sr. | |
| 4,330,106 | A | 5/1982 | Chisholm | |
| 4,452,431 | A | 6/1984 | Stephens et al. | |
| 4,498,660 | A | 2/1985 | Brema et al. | |
| 4,655,434 | A | 4/1987 | Bronstad | |
| 4,674,911 | A | 6/1987 | Gertz | |
| 4,678,166 | A | 7/1987 | Bronstad et al. | |
| 4,681,302 | A | 7/1987 | Thompson | |
| 4,730,810 | A | 3/1988 | Rambaud | |
| 4,739,971 | A | 4/1988 | Ruane | |
| 4,844,424 | A | 7/1989 | Knudslien | |
| 5,022,782 | A | 6/1991 | Gertz et al. | |
| 5,039,066 | A | 8/1991 | Stacey | |
| 5,118,056 | A | 6/1992 | Jeanise | |
| 5,123,773 | A | 6/1992 | Yodock | |
| 5,207,302 | A | 5/1993 | Popp et al. | |
| 5,391,016 | A | 2/1995 | Ivey et al. | |
| 5,609,327 | A | 3/1997 | Amidon | |
| 5,664,905 | A * | 9/1997 | Thompson et al. | 404/6 |
| 5,729,607 | A | 3/1998 | Defries | |
| 5,749,256 | A * | 5/1998 | Bodnar | 72/333 |
| 5,797,591 | A | 8/1998 | Krage | |
| 5,820,110 | A | 10/1998 | Beu | |
| 5,851,005 | A | 12/1998 | Muller et al. | |
| 5,921,021 | A | 7/1999 | Coates | |
| 5,967,497 | A * | 10/1999 | Denman et al. | 256/13.1 |
| 6,059,491 | A | 5/2000 | Striefel et al. | |
| 6,065,738 | A | 5/2000 | Pearce et al. | |
| 6,065,894 | A | 5/2000 | Wasson et al. | |
| 6,085,458 | A | 7/2000 | Gau | |
| 6,109,597 | A | 8/2000 | Sicking et al. | |
| 6,149,134 | A | 11/2000 | Bank et al. | |
| 6,173,943 | B1 | 1/2001 | Welch et al. | |
| 6,290,427 | B1 | 9/2001 | Ochoa | |
| 6,299,141 | B1 | 10/2001 | Lindsay et al. | |
| 6,398,192 | B1 * | 6/2002 | Albritton | 256/13.1 |
| 6,401,510 | B1 * | 6/2002 | Morse et al. | 72/327 |
| 6,409,417 | B1 | 6/2002 | Muller et al. | |
| 6,488,268 | B1 | 12/2002 | Albritton | |
| 6,516,573 | B1 | 2/2003 | Farrell et al. | |
| 6,558,067 | B2 | 5/2003 | Ochoa | |
| 6,619,630 | B2 | 9/2003 | Albritton | |
| 6,719,483 | B1 | 4/2004 | Welandsson | |
| 6,729,607 | B2 | 5/2004 | Alberson et al. | |
| 6,863,264 | B2 | 3/2005 | Johansson et al. | |
| 6,902,150 | B2 * | 6/2005 | Alberson et al. | 256/13.1 |
| 6,926,462 | B1 | 8/2005 | Fuganti et al. | |
| 6,932,327 | B2 | 8/2005 | Alberson et al. | |
| 6,948,703 | B2 | 9/2005 | Alberson et al. | |
| 6,962,328 | B2 | 11/2005 | Bergendahl | |
| 7,086,805 | B2 | 8/2006 | Smith et al. | |
| 7,216,854 | B2 | 5/2007 | Bryan | |
| 7,234,275 | B1 | 6/2007 | Haggy et al. | |
| 7,396,184 | B2 | 7/2008 | La Turner et al. | |
| 7,445,402 | B1 | 11/2008 | Chen | |
| 7,537,411 | B2 | 5/2009 | Yodock, Jr. et al. | |
| 7,699,293 | B2 | 4/2010 | James | |
| 7,722,282 | B2 | 5/2010 | Meidan | |
| 7,785,031 | B2 | 8/2010 | Vellozzi et al. | |
| 8,376,650 | B2 * | 2/2013 | Hild et al. | 404/6 |
| 2001/0013596 | A1 * | 8/2001 | Sicking et al. | 256/13.1 |
| 2001/0048846 | A1 | 12/2001 | Ochoa | |
| 2002/0025221 | A1 | 2/2002 | Johnson | |
| 2002/0179894 | A1 | 12/2002 | Albritton | |
| 2003/0222254 | A1 | 12/2003 | Bergendahl | |
| 2004/0140460 | A1 | 7/2004 | Heimbecker et al. | |
| 2005/0007507 | A1 | 1/2005 | Ono et al. | |
| 2005/0036832 | A1 | 2/2005 | Smith et al. | |
| 2005/0047862 | A1 | 3/2005 | Smith et al. | |
| 2005/0063777 | A1 | 3/2005 | Smith et al. | |
| 2005/0077507 | A1 | 4/2005 | Heimbecker et al. | |
| 2005/0077508 | A1 | 4/2005 | Bronstad | |
| 2005/0126110 | A1 * | 6/2005 | Durney et al. | 52/720.1 |
| 2006/0013650 | A1 | 1/2006 | Meidan et al. | |
| 2006/0017048 | A1 | 1/2006 | Alberson et al. | |
| 2006/0054876 | A1 | 3/2006 | LaTurner et al. | |
| 2006/0102883 | A1 | 5/2006 | Troutman et al. | |
| 2006/0207212 | A1 * | 9/2006 | Durney | 52/731.7 |
| 2007/0102689 | A1 * | 5/2007 | Alberson et al. | 256/13.1 |
| 2007/0252124 | A1 | 11/2007 | Heimbecker | |
| 2008/0000062 | A1 * | 1/2008 | Boltz | 29/243.5 |
| 2009/0146121 | A1 * | 6/2009 | Sharp et al. | 256/13.1 |

FOREIGN PATENT DOCUMENTS

| | | | |
|---|---|---|---|
| DE | 85 11 870 | U1 | 4/1986 |
| EP | 0816568 | | 1/1998 |
| EP | 0 924 348 | A2 | 6/1999 |
| EP | 1152104 | | 11/2001 |
| EP | 1 612 333 | A1 | 1/2006 |
| EP | 1619308 | | 1/2006 |
| FR | 2701046 | | 8/1994 |
| FR | 2846673 | | 5/2004 |
| GB | 2 431 955 | A | 5/2007 |
| NZ | 528396 | | 9/2003 |
| WO | 9629473 | | 9/1996 |
| WO | 9844203 | | 10/1998 |
| WO | 9932728 | | 7/1999 |
| WO | 03064772 | | 8/2003 |
| WO | 2005028757 | | 3/2005 |

* cited by examiner

FRANGIBLE POSTS

STATEMENT OF CORRESPONDING APPLICATIONS

This application is based on the provisional specification filed in relation to New Zealand Patent Application Number 556782, the entire contents of which are incorporated herein by reference.

TECHNICAL FIELD

The present invention relates to improvements in and relating to frangible posts. In particular, the invention relates to a method of producing a frangible post by compressing a portion of the post. The present invention also includes posts formed by such a method and barriers including such posts.

BACKGROUND ART

One application where a plurality of frangible posts is used is in the construction of a guardrail or barrier systems for roading networks. The present invention will now for ease of reference only be described in relation to use in roading networks and barrier systems. However, it will be appreciated that there are a number of different applications where frangible post(s) may be required.

In the construction of roadside barriers, it is desirable on one hand to have a post that can provide sufficient support to withstand a typical side-on impact between an errant vehicle and the barrier. For example, where an impact of an errant vehicle occurs in a direction substantially laterally with respect to the direction of the post or road, the post provides the barrier with the ability to redirect the vehicle. However on the other hand, it is also desirable that the same post should be sufficiently weakened so as to yield during end-on impacts between an errant vehicle and the barrier, to thereby in most cases reduce the severity of impact forces experienced by the occupants of the vehicle.

There are number of methods currently known to produce frangible posts having a region of weakness making them suitable for use in roadside barriers. One such typical conventional method usually involves cutting out a portion of the post to form a series of holes, slots or notches either on the side of or within the post member. Such a method is described in U.S. Pat. No. 6,793,204, where elongated slots are formed within the post members. However one drawback with this method is that it produces an unnecessary waste of post material, which is needlessly expensive.

Another typical method for producing a region of weakness in a post is described in U.S. Pat. No. 6,398,192. In this patent, the post is cut into two segments, which are then rejoined by bolting or plug welding so as to create a region of weakness at the join.

One disadvantage with these current methods is that they require a number of steps, and/or the steps all involve a degree of skill and technique in order to form a suitable weakened region. This is particularly important for methods where the posts are cut and subsequently rejoined together. Another disadvantage with the current methods is that the weakened region has to be created prior to the post being used in the construction of the barrier. This unnecessarily increases the costs and time in manufacturing the post and/or barrier, as further materials and labor is required to be expended.

It would therefore be useful if there could be provided a method of producing a region of weakness in a post which is straightforward and easy to implement. Furthermore, a method which ensures the region of weakness is always located in the correct position on a post along with being in the correct orientation with respect to the road would be advantageous. It would also be a great benefit if there could be provided a method which could be undertaken on a site and/or undertaken even after a post has been used in the construction of a barrier.

It is an object of the present invention to address one or more of the foregoing problems or at least to provide the public with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Further aspects and advantages of the present invention will become apparent from the ensuing description which is given by way of example only.

DISCLOSURE OF INVENTION

According to one aspect of the present invention there is provided a method of producing a frangible post, characterised by the step of forming a region of weakness by compressing a portion of at least one surface and/or edge of the post.

According to another aspect of the present invention there is provided a method of forming a frangible post, characterised by the step of forming a region of weakness by compressing a portion of at least one surface and/or edge of the posts in situ.

According to another aspect of the present invention there is provided a post which has a region of weakness formed by compressing a portion of at least one surface or edge of the post.

The inventor of the present invention has found that by forming an indent in via compression of a portion of a post, a suitable region of weakness is created to allow the post to deform in the area of the indent when the post is subjected to a sufficient force in a pre-determined direction.

The term 'frangible' as used herein refers to a situation where a post is broken or deformed into an unusable state. The post may be broken or deformed by breaking the post into two or more parts, or by bending the post out of shape.

Preferably, the post may be frangible upon impact of a force in at least one direction. More preferably, the post may be frangible in the region of weakness upon impact of a force from one angle yet retain tensile strength upon impact from a different angle.

It will be appreciated that a person skilled in the art will know of the range of suitable materials from which the post can be made. For example, the post may be formed from steel or wood, however this should not be seen as limiting.

It will also be appreciated by a person skilled in the art that the post of the present invention may come in a variety of sizes and have a variety of cross sections. For example, the post may be substantially rectangular or circular, or the cross sections may be 'I', 'X' or 'T' configuration.

It will also be appreciated that a person skilled in the art will know of the post may come in a variety of configurations. In some embodiments, the post may be formed from a single member. Other embodiments, the post may be formed by multiple members that are integrally connected or welded together.

Preferably, the region of weakness may be formed by at least one indent. Preferably, the indent may be at least one notch. Preferably, the notch or notches may have a V shape. The terms indent and notch will now be used interchangeably through but the specification, and this should not be seen as departing from the scope of the present invention.

Preferably, the notch or notches may be located on at least one lateral axis or side of the post or post member(s) at least one point along the length of the post. It will be appreciated that a person skilled in the art will know of the preferred positions for the notches, so the post is frangible upon application of a force at the desired angle. Preferably, the notch or notches may be located substantially close to ground level. However, this should not be seen as limiting.

Preferably, there may be at least two notches on a post member. In preferred embodiments, the notches may be substantially opposed to one another on different sides or edges of the post member. Preferably, in this embodiment the notches may be mirror images of each other. In other preferred embodiments, the notches may alternate on different sides along the length of the posts, edges or lateral axes.

It will be appreciated that a person skilled in the art will know of the various placements of the indents or notches, depending on the post configuration, the number of members forming the post and/or number of required notches.

Preferably, the region of weakness is formed by a compressing action where pressure is applied to a particular area on the post member(s) to deform the post so as to form an indent having a reduced width in comparison to the original width of the post in that region.

Preferably, the reduced width of the region of weakness may be a thickness of at least one tenth of the initial post width. For example, the width of the post member may be reduced from 5 mm to 0.5 mm. However, it will be appreciated that the width of indent may vary depending on the original width of the post member(s) and the degree of frangibility required.

Preferably, the compressing action may produce substantially little or no residue material from the post.

Preferably, the compressing action may be achieved by crimping the surfaces or edges of one or more post member together.

It will be appreciated that a person skilled in the art will know of the various tools that are suitable to compress the post surface or edge. In preferred embodiments, the compressing action may be achieved by a tool with jaws wherein such that the length and/or configuration region of weakness are always formed in the substantially same plane on each post member.

It will be appreciated by a person skilled in the art that the jaws will have suitable projections, preferably with an inverse shape to that of the desired shape of the indent or notches. For example, where the indents are in a V-shape, the projections resemble an inverted V-shape.

In one embodiment to form the indent or notches, the post may be positioned into a press which is equipped with jaws substantially as described above. The post members are positioned so each jaw sits either side of the post members. Once the post members are positioned, the jaws are then pressed together, for example by hydraulic rams, until the correct depth of indent is achieved. Preferably, the correct depth is achieved by having a suitable stop to ensure the jaws can only compress press the projections into the post member a set distance.

Preferably, the notch or notches may be formed after the post is positioned in the ground. While in other embodiments, the notch or notches may be formed prior to the post being positioned in the ground.

According to a further aspect of the present invention, there is a method as substantially described above wherein the post is compressed following the placement the posts forming the barrier.

According to a further aspect of the present invention, there is a frangible post produced from a method as claimed in any one of the above claims.

According to a further aspect of the present invention, there is a post which is a region of weakness formed by compressing a portion of at least one surface or edge of the post.

A barrier including at least one frangible post as substantially described above.

Preferably, the post may be compressed following the placement the posts forming the barrier.

Thus, it should be appreciated that preferred embodiments of the present invention may have a number of advantages over the prior art which can include:

- Providing a more simplified and easy method to implement and form a region of weakness on a post;
- not producing any unnecessary waste or residue material from the post; and
- a method that can be used on site during the construction of a rail or barrier system without prior preparation of the posts, which further ensures that the region of weakness is located in the correct position on the post during construction.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
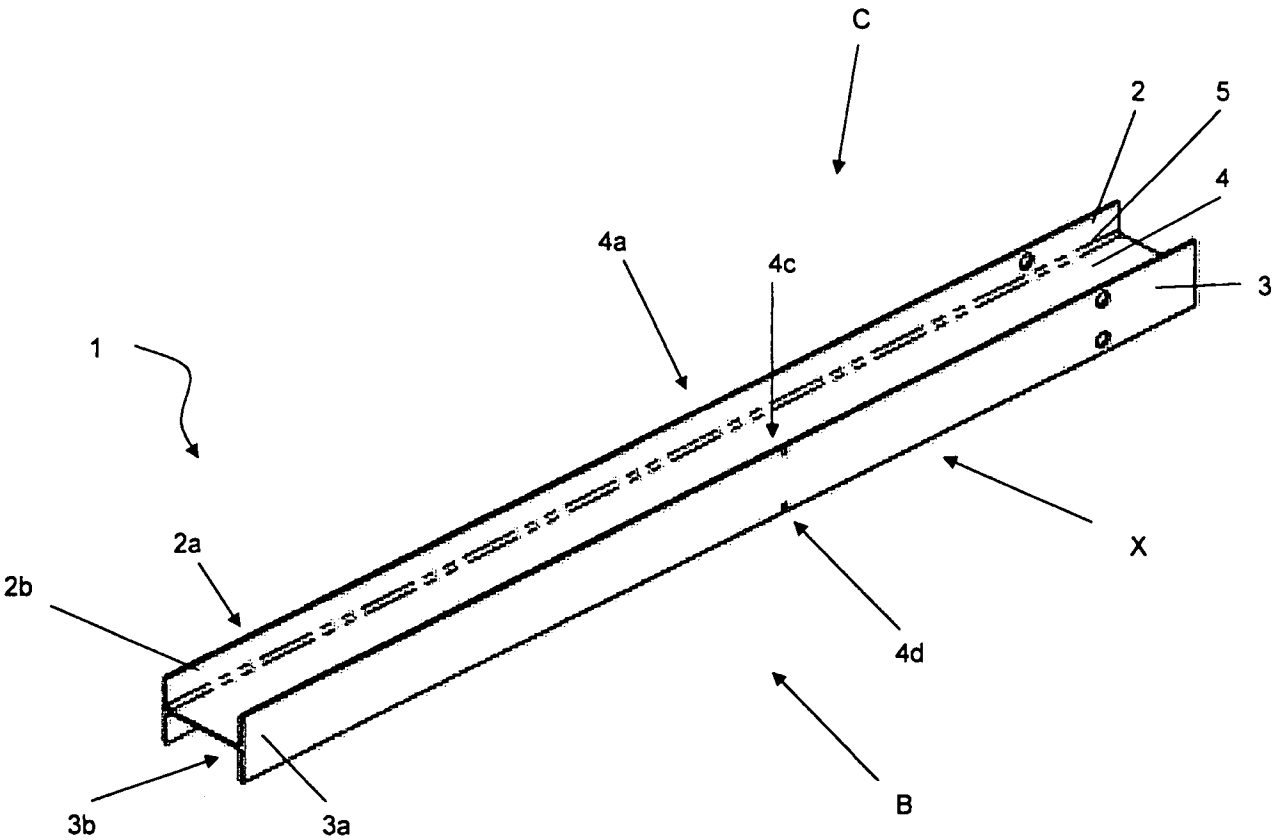
FIG. 1 shows a perspective view of one preferred embodiment of a frangible post produced from the method of the present invention.
Figure 2:
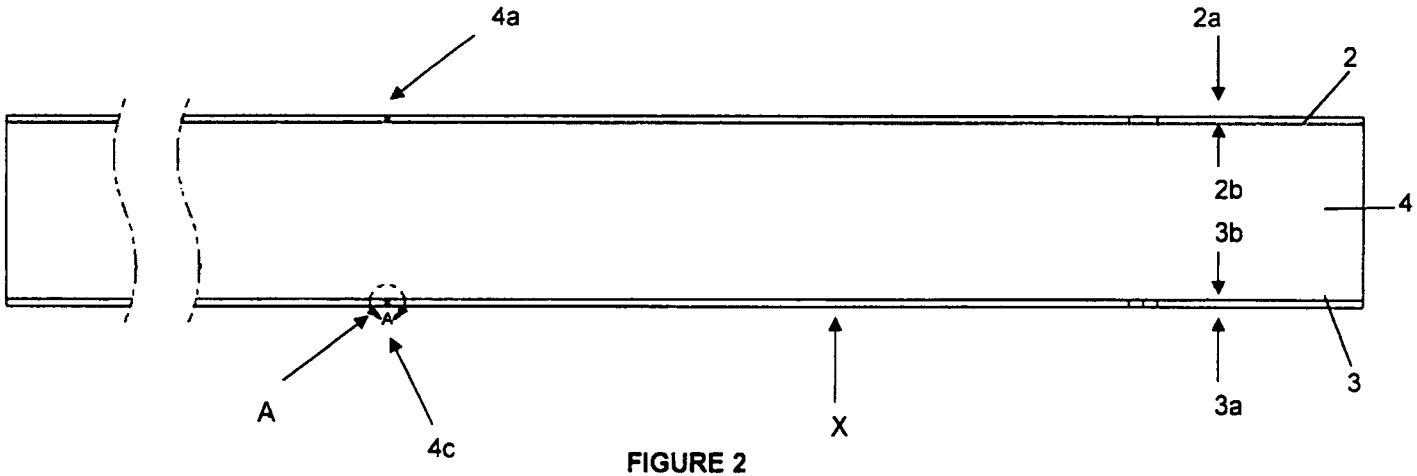
FIG. 2 shows a top view of the post shown in FIG. 1.
Figure 3:
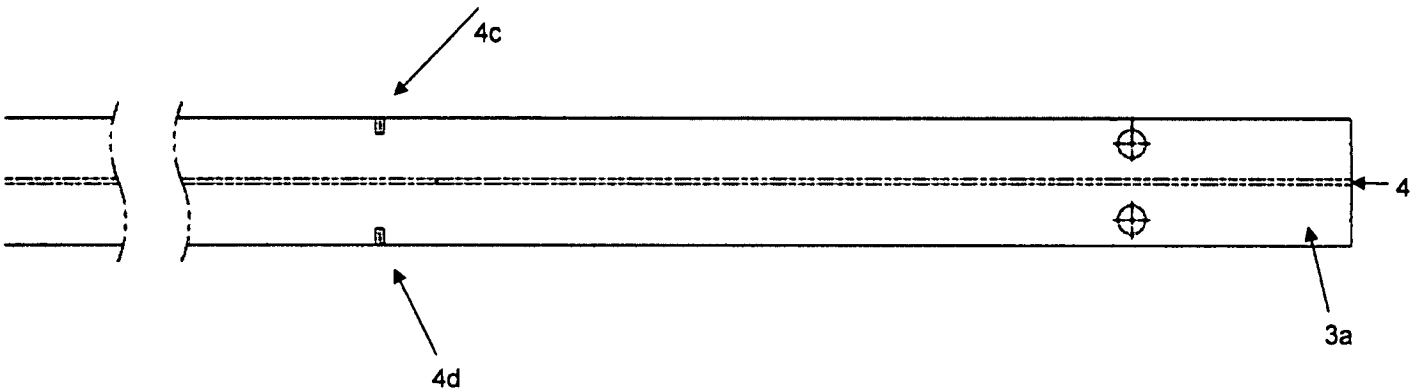
FIG. 3 shows a side view of the post shown taken from direction X as shown in FIGS. 1 and 2.

FIGS. 1 to 3 show a post 1. Post 1 is in an 'I' configuration, with two post members 2 and 3 connected in parallel by a central post member 4. The central post member 4 is positioned substantially within the centre of members 2 and 3 along line 5.

Each post member 2 and 3 has two surfaces indicated by 2*a*/2*b* and 3*a*/3*b* respectively. Each surface 2*a*/2*b* and 3*a*/3*b* of post members 2 and 3, has region of weakness formed by a series of indents 4*a* to 4*d* (indent 4*b* is not visible in the drawings). As shown, the indents 4*a* to 4*d* are located substantially at the end of each post member 2 and 3.

Figure 4:
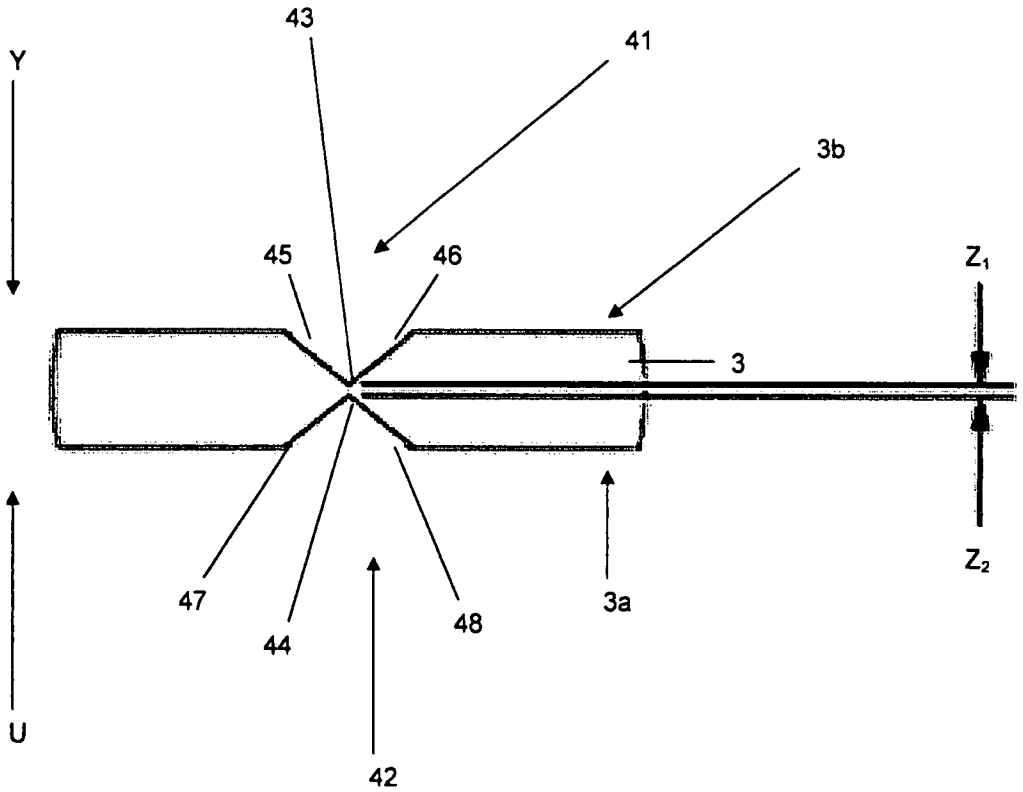
FIG. 4 shows an enlarged view of the region of weakness, formed by the method of the present invention, as indicated by Region A in FIG. 2.

With respect to FIG. 4, there is a detail view of the indent 4*c*, as indicated by region A on FIG. 2. Indent 4*c* is formed by two V-shaped notches 41 and 42 on surfaces 3*a* and 3*b* of member 3. Both notches 41 and 42 have a central point 43 and 44 respectively which are flanked by arms 45, 46, 47 and 48.

Notches 41 and 42 are formed by compressing the surfaces 3*a* and 3*b* of post member 3 in the directions of arrows Y and U. This compression results in the central points 43 and 44 of the indents 41 and 42 to form a region of the post having a reduced width, as indicated by arrows $Z_1$ and $Z_2$ with respect to the non-compressed surfaces of the post member.

In accordance with one preferred embodiment of the present invention, during the construction of a barrier (not shown) the post 1 is positioned in the ground such that post members 2 and 3 are parallel with, and post member 4 is perpendicular to, the road (not shown) and rails (not shown) forming the barrier. The post 1 is placed in the ground with a suitable amount of the post members protruding from the ground. The indents 4*a* to 4*d* are then formed in the surface of post members 2 and 3 by compressing a portion of the post members 2 and 3 in the required place by a suitable tool (not shown).

The notches are formed by a press (not shown) having two jaws which are "pressed" together by hydraulic rams, to a set distance dictated by a suitable stop. The jaws of the tool contain suitable triangular shaped projections. The post members 2 and 3 are placed, at the required position, into the jaws of the press. The jaws are then closed together so the projections press into the post members 2 and/or 3 to form the indents 4*a* to 4*d* having the required depth as dictated by the stop.

Upon impact of the post (and barrier) in direction C, the notches 4*a* to 4*d* allow members 2 and 3 of the post 1 to collapse and/or fail. In comparison, if an impact occurs substantially in direction B, the post will retain tensile strength.

Aspects of the present invention have been described by way of example only and it should be appreciated that modifications and additions may be made thereto without departing from the scope thereof as defined in the appended claims.

What I claim is:

1. A method of producing a frangible post, comprising:

compressing portions of at least one of opposed surfaces and edges of a planar post member by applying opposing forces to form a pair of opposed indentations aligned along a first axis and to form a region of weakness in said post member between said opposed indentations, the compressing action being achieved by crimping at least one of the surfaces and the edges of the post member together, wherein said post member is frangible along the region of weakness upon receiving an impact in a direction substantially parallel to said first axis while retaining tensile strength upon impact in a direction substantially perpendicular to said first axis and to said post member, and wherein the compressing step produces substantially little or no residue material from the post.

2. The method as claimed in claim 1 wherein the post is formed from a single post member.

3. The method as claimed in claim 1 wherein the post is formed by multiple post members that are integrally connected together.

4. The method as claimed in claim 1 wherein said opposed notches indentations have a V-shape.

5. The method as claimed in claim 1 wherein said opposed indentations are located substantially close enough to ground level for the post to be frangible upon impact of a vehicle when the post is installed in the ground.

6. The method as claimed in claim 1 wherein the method includes compressing, opposing edges of the planar post member a plurality of times to form a plurality of opposed indentations.

7. The method as claimed in claim 1 wherein the opposed indentations are mirror images of each other.

8. The method as claimed in claim 4 wherein the plurality of indentations alternate on different sides of said post member along the length of the post.

9. The method as claimed in claim 1 wherein the step of compressing is achieved by a tool with jaws wherein at least one of the length and the configuration of the jaws is such that the region of weakness is always formed in the substantially same plane on the post member.

10. The method as claimed in claim 9 wherein the jaws have suitable projections, each with an inverse shape to that of the shape of an indentation forming the region of weakness.

11. The method as claimed in claim 9 wherein the post member is positioned so each jaw sits on either side of the posts member, the jaws are then pressed together, until the correct depth of indentation is achieved.

12. The method as claimed in claim 9 wherein a depth is achieved by positioning a stop to ensure that the jaws can only compress the projections into the post member a set distance.

13. The method as claimed in claim 1 wherein the opposed indentations are formed after the post is positioned in the ground.

14. The method as claimed in claim 1 wherein the opposed indentations are formed prior to the post being positioned in the ground.

15. The method as claimed in claim 1 wherein the method comprises compressing portions of opposed edges of a second planar post member by applying opposing forces to form a second pair of opposed indentations aligned along a second axis and to form a second region of weakness in said post member between said opposed indentations, wherein said second axis is substantially parallel to said first axis, said first and second post members being frangible along the region of weaknesses upon receiving an impact in a direction substantially parallel to said first and second axes.

16. The method as claimed in claim 15, wherein the pair of opposed indentations and the second pair of opposed notches are located at a similar height on the planar post member and the second planar post member.

* * * * *